US007200937B2

(12) United States Patent
Richard et al.

(10) Patent No.: US 7,200,937 B2
(45) Date of Patent: Apr. 10, 2007

(54) RAZOR HEAD WITH MOVEABLE BLADE PACKAGE

(75) Inventors: Paul D. Richard, Shelton, CT (US); Frank Anthony Ferraro, Trumbull, CT (US); Robert Victor Lozeau, Madison, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 08/785,269

(22) Filed: Jan. 17, 1997

(65) Prior Publication Data

US 2004/0025350 A1 Feb. 12, 2004

(51) Int. Cl.
*B26B 21/22* (2006.01)
*B26B 21/52* (2006.01)

(52) U.S. Cl. ..... 30/50; 30/527

(58) Field of Classification Search ..... 30/48, 30/49, 50, 346.57, 527
See application file for complete search history.

(56) References Cited

U.S. PATENT DOCUMENTS 4,337,575 A * 7/1982 Trotta ..... 30/47
4,516,320 A * 5/1985 Peleckis ..... 30/49
4,785,534 A * 11/1988 Lazarchik ..... 30/50
5,070,612 A * 12/1991 Abatemarco ..... 30/50
5,347,714 A * 9/1994 Prochaska ..... 30/50
5,557,851 A * 9/1996 Ortiz ..... 30/50
5,666,729 A * 9/1997 Ferraro ..... 30/346.57 X
2003/0204954 A1* 11/2003 Wain ..... 30/49

FOREIGN PATENT DOCUMENTS

| | | |
|---|---|---|
| EP | 045879 | 2/1982 |
| EP | 312663 | 4/1989 |
| WO | 9632233 | 10/1996 |

OTHER PUBLICATIONS

Dynamics, J. L. Meriam , John Wiley and sons Inc. Dec. 1966 pp. 148-149.*

* cited by examiner

*Primary Examiner*—Hwei-Siu C. Payer
(74) *Attorney, Agent, or Firm*—Michaud-Duffy Group LLP

(57) ABSTRACT

Razor heads and shaving systems are disclosed which comprise multiple blades and/or multiple skin-engaging elements which are supported to provide those elements with composite motion in response to forces encountered during shaving, i.e. those elements move along non-parallel paths. In one embodiment, a razor head comprises a base, a guard element and a blade package movably supported for movement relative to said guard element. A movable support for the blade package comprises a first resilient portion extending generally forwardly from the base toward the guard element and a second resilient portion extending generally upwardly from a forward portion of the first resilient portion toward the blade package.

13 Claims, 12 Drawing Sheets

RAZOR HEAD WITH MOVEABLE BLADE PACKAGE

The present invention is directed to a razor head having a moveable blade package and, more particularly, to a razor head comprising a blade package which is moveable in response to forces encountered during shaving. As used herein, the term "razor head" is meant to include cartridges adapted to be connected to a separate razor as well as the operative cutting portion of a disposable razor wherein the handle and cutting portion are formed as a unit.

BACKGROUND

Shaving systems such as safety razors have found widespread use for providing close and comfortable shaves. Safety razors typically include one or two blades disposed between a guard and a cap. Traditionally, each of these skin engaging elements was fixed relative to other skin-engaging elements. In recent years, dynamic shaving systems have been introduced which permit one or more of the skin-engaging elements of the shaving system to move in response to forces encountered during shaving e.g., one popular system comprises a plurality of flexible blades positioned within a flexible housing which flex in response to shaving forces in order to closely follow the contours of non-planar skin surfaces. Other systems on the market comprise a blade disposed within a rigid housing wherein the blades are moveably supported for independent movement in response to shaving forces. The movement of the blade edges in these previously disclosed systems is generally parallel to one another.

Those skilled in the art appreciate that the two most important aspects of a shave are closeness and comfort. A shaving system is not successful if it does not provide a very close shave. Similarly, a shaving system must be comfortable and not cause excessive nicks and cuts to the skin surface being shaved.

SUMMARY OF THE INVENTION

One aspect of the present invention is directed to a shaving system comprising multiple blades which are supported to provide the blade edges with composite motion in response to forces encountered during shaving. As used herein, the term "composite motion" is used to indicate that the blade edges referred to move along non-parallel paths.

One preferred embodiment of the present invention comprises a shaving system comprising a razor head comprising a base, a guard element and a blade package movably supported for movement relative to said guard element. This blade package comprises at least one blade having a sharpened edge and a cap member. A movable support for the blade package comprises a first resilient portion extending generally forwardly from the base toward the guard element and a second resilient portion extending generally upwardly from a forward portion of the first resilient portion toward the blade package.

Another aspect of the present invention is directed to a shaving system comprising a razor head with a base, a guard element and a blade package movably supported for movement relative to the guard element. This blade package comprises at least one blade having a sharpened edge and a cap member. A movable support comprises a resilient portion with a forward surface which is generally disposed in a vertical plane passing through the edge of a leading blade. According to other embodiments of the present invention, a resilient portion of a moveable blade package support has a forward portion which is no greater than 0.050 inches rearwardly of a vertical plane passing through the edge of the leading blade.

Still further embodiments of the present invention comprise a razor head with a support, a first blade and a second blade, the blades each comprise an edge and are movably supported for movement relative to the support. The first blade edge moves along a first path and the second blade edge moves along a second path which is not parallel to the first path in response to forces encountered during shaving. In these embodiments of the present invention, the support can be below, to one or more sides, and/or above portions of the blades.

DETAILED DESCRIPTION

Figure 1:
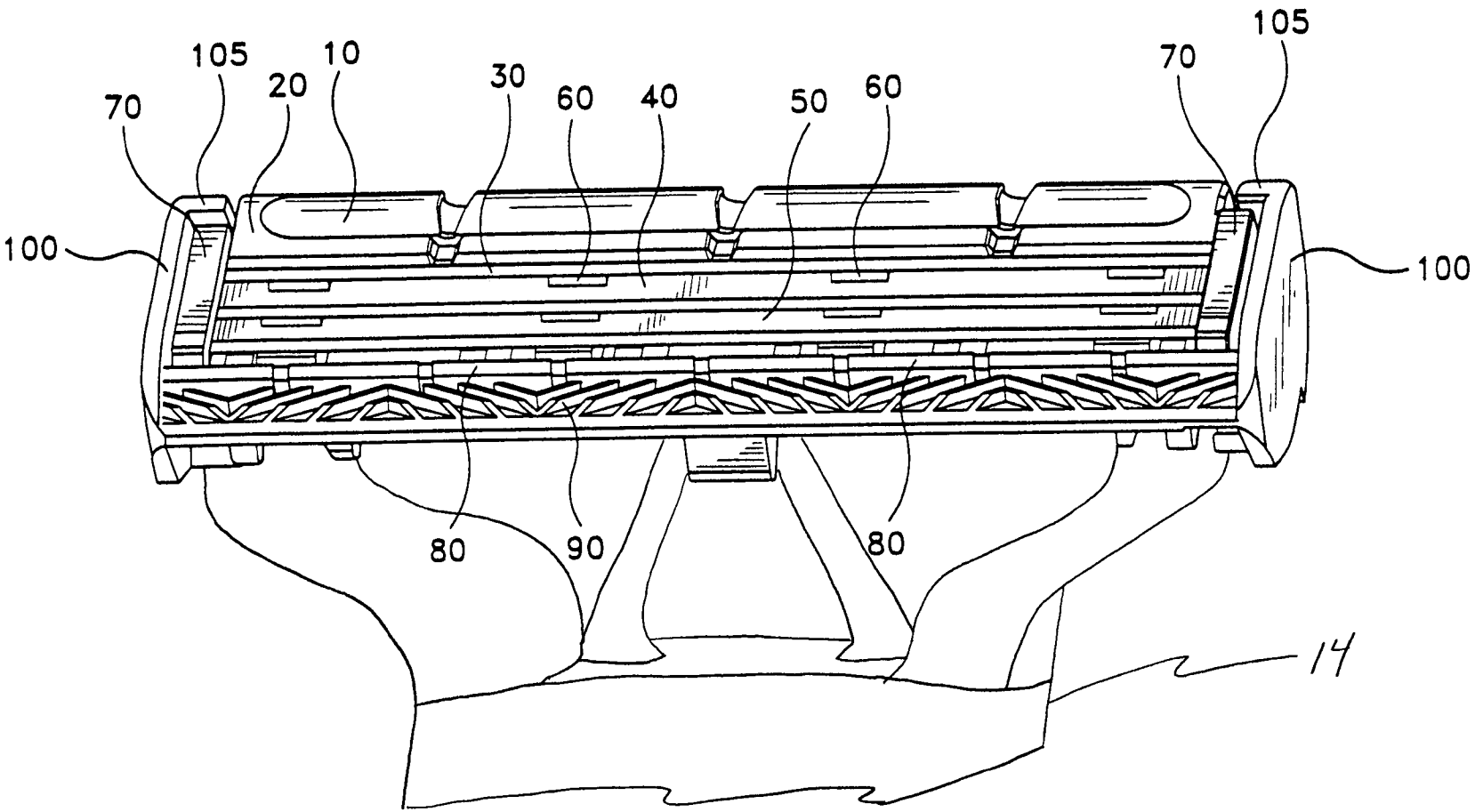
FIG. 1 is a top-frontal perspective view of one embodiment of the present invention.

Various embodiments of the present invention provide a razor head comprising a plurality of blades which are linked for coordinated movement along non-parallel paths in response to forces encountered during shaving. It has been found that the various embodiments of the present invention provide shaves which are both close and comfortable.

One embodiment of the present invention which is in the form of a razor head is shown in the Figures. This illustrated embodiment comprises a shaving aid 10 positioned on a cap 20, a cap blade 30, center blade 40, leading blade 50, blade supports 60, and blade package side walls 70, which collectively form a moveable blade package. In an alternative embodiment, one of the blades, preferably the middle blade, may be unsharpened. In this illustrated embodiment, the entire blade package is supported for movement relative to a guard element 80 comprising a resilient skin-engaging portion 90 and base side walls 100. In the illustrated embodiments, blade package side wall 70 advantageously covers the corners and sides of the blades to protect consumers from sharp blade corners. The perspective view in FIG. 1 and the top view of FIG. 2 illustrate a space between base side walls 100 and blade package side walls 70 which are not directly connected.

Figure 3:
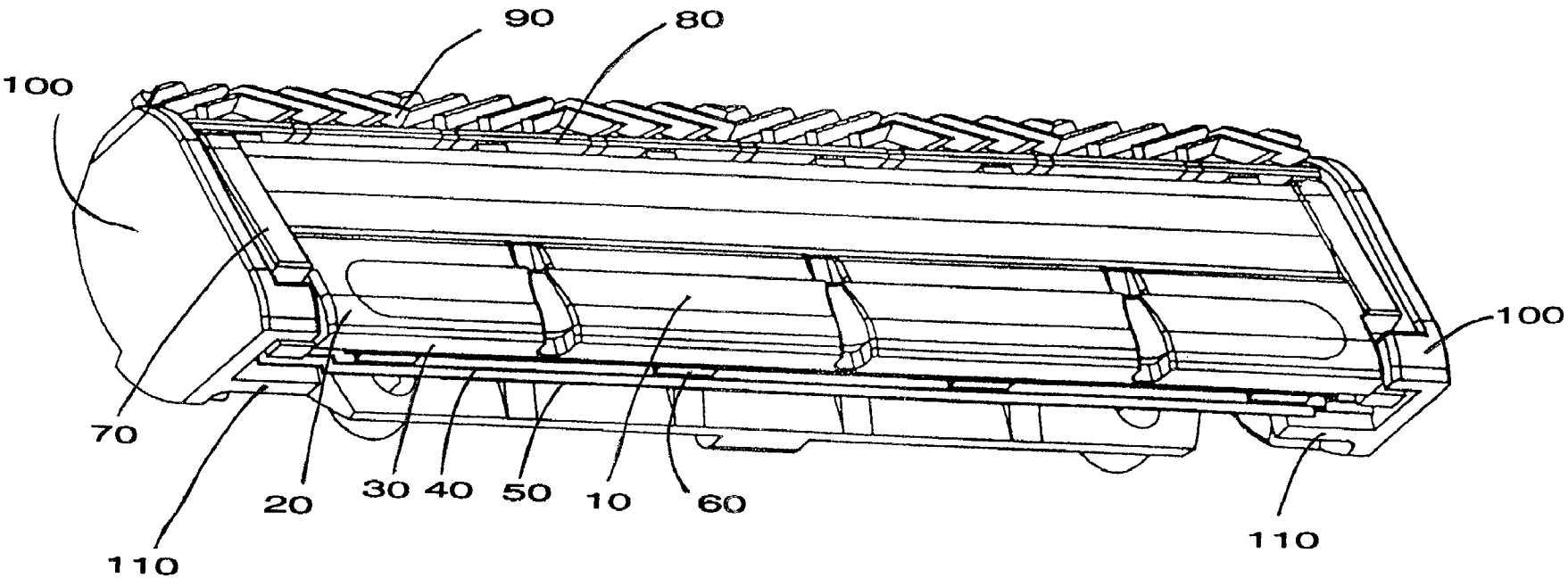
FIG. 3 is a top-rear perspective view of the razor head of FIG. 1.

As shown in FIG. 3, which is a top-rear perspective view, outer side walls 100 are connected to a base 110. Base 110 is selectively engagable with a razor handle in a manner set forth in greater detail below.

The skin engaging elements of the illustrated embodiment of the present invention are moveably supported for composite motion relative to the base in response to shaving forces.

Figure 2:
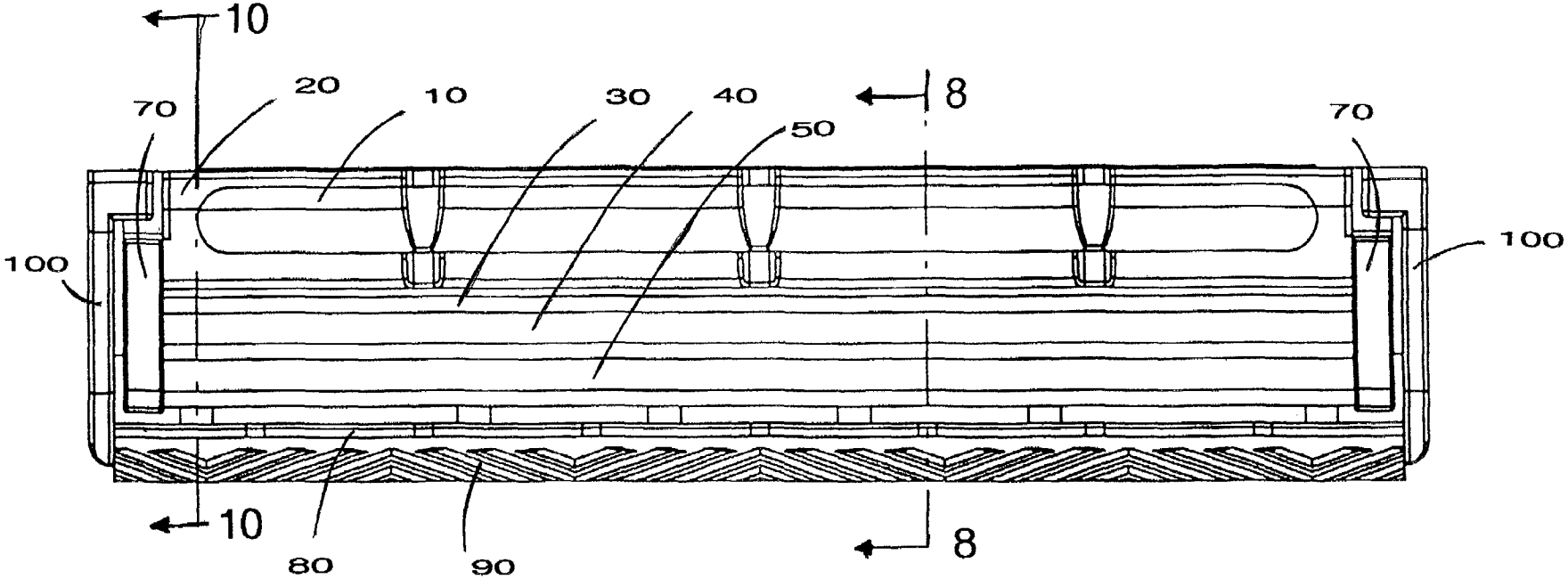
FIG. 2 is a top view of the razor head shown in FIG. 1.
Figure 8:
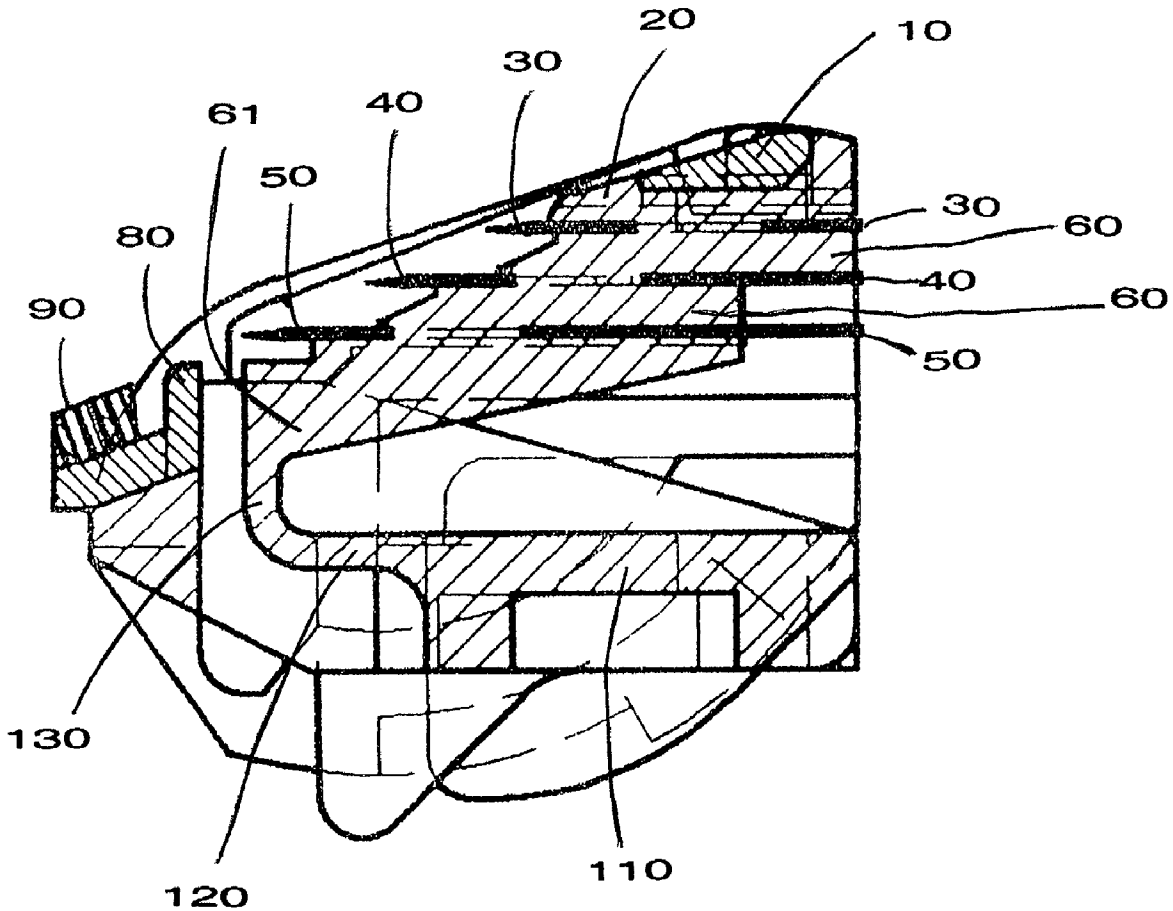
FIG. 8 is a cross-sectional view taken along line 8—8 of FIG. 2.
Figure 9:
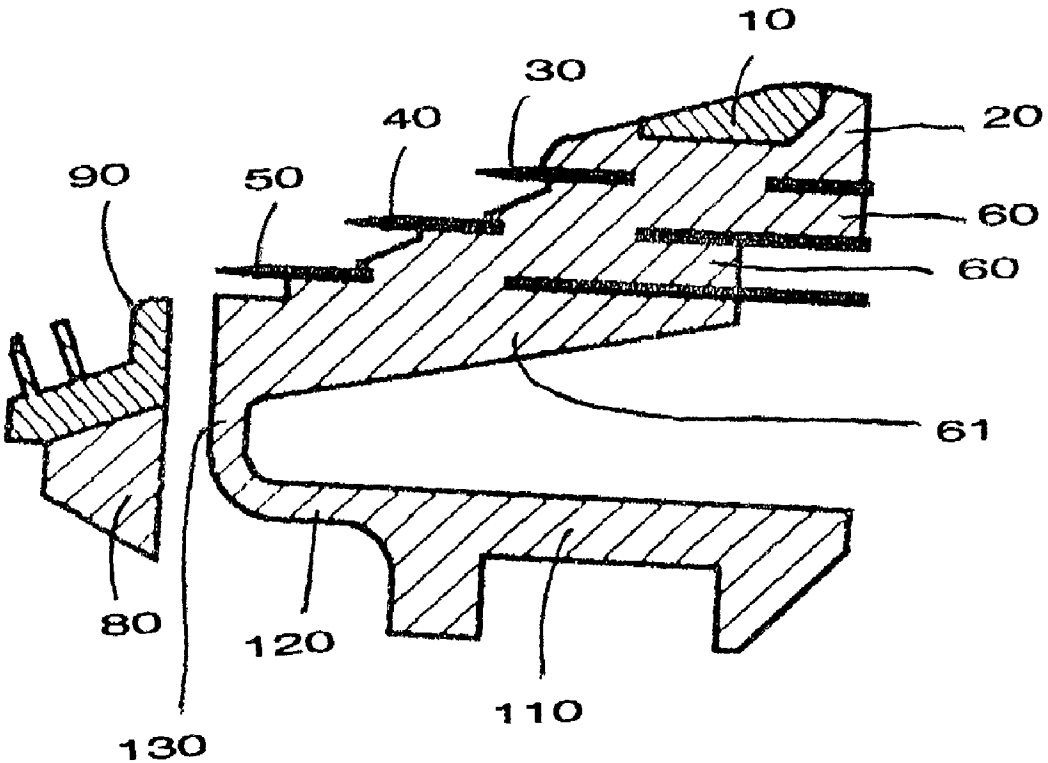
FIG. 9 is a partial cross-sectional view taken along line 8—8 of FIG. 2, with portions removed.

The connection between the blade package and the base is best shown in the cross-sectional views of FIGS. 8 and 9 which are cross-sectional views along line 8—8 of FIG. 2. In this illustrated embodiment, a resilient support comprises a first portion 120 which extends generally forwardly from support base 110. At a position spaced from support base 110, the resilient support comprises a second portion 130 which is connected to the first resilient portion 120 and the blade package. In this illustrated embodiment the lower end of second resilient portion 130 is integrally formed with the forward most portion of first resilient portion 120 while the upper end of second resilient support portion 130 is integrally formed with the lower portion of the blade package. As illustrated, the upper portion of second resilient support portion 130 is integrally formed with the lower portion 61 of a blade support which is part of the blade package.

The cross-sectional view of FIG. 9 has portions of the razor head removed to more clearly illustrate that base 110, first resilient support portion 120 and second resilient support portion 130 as well as lowermost blade support 61, upper blade support 60 and cap 20 are preferably integrally formed of a single material. For example, this illustrated preferred embodiment of the present invention can be formed by an insert molding or sequential molding process wherein the entire razor head is molded around the blades in a single step and the resilient guard portion 90 and shaving aid 10 are molded in a subsequent injection step in the same mold but after the mold cavity has been modified.

According to an alternative embodiment of the present invention, at least two of the supporting members are formed out of different materials. For example, while the base can be formed of a rigid thermoplastic, it may be desirable to form one or more of the resilient supports out of a different thermoplastic, e.g., a thermoplastic elastomer, or another rubber-like material.

The extent of downward movement of the blade package is advantageously limited by shelves 115. Most preferably, shelves 115 are integrally formed with base 110.

Figure 5:
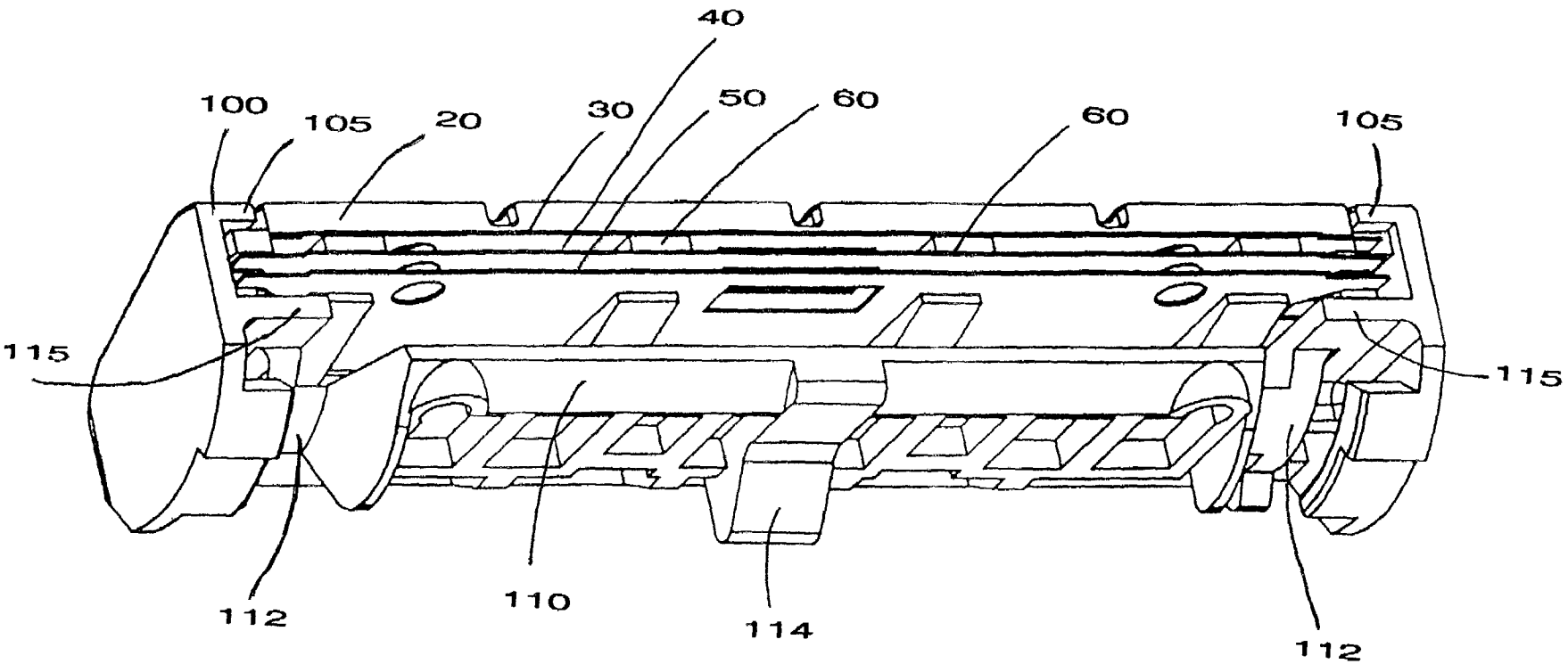
FIG. 5 is a bottom perspective view of the razor head shown in FIG. 1.
Figure 6:
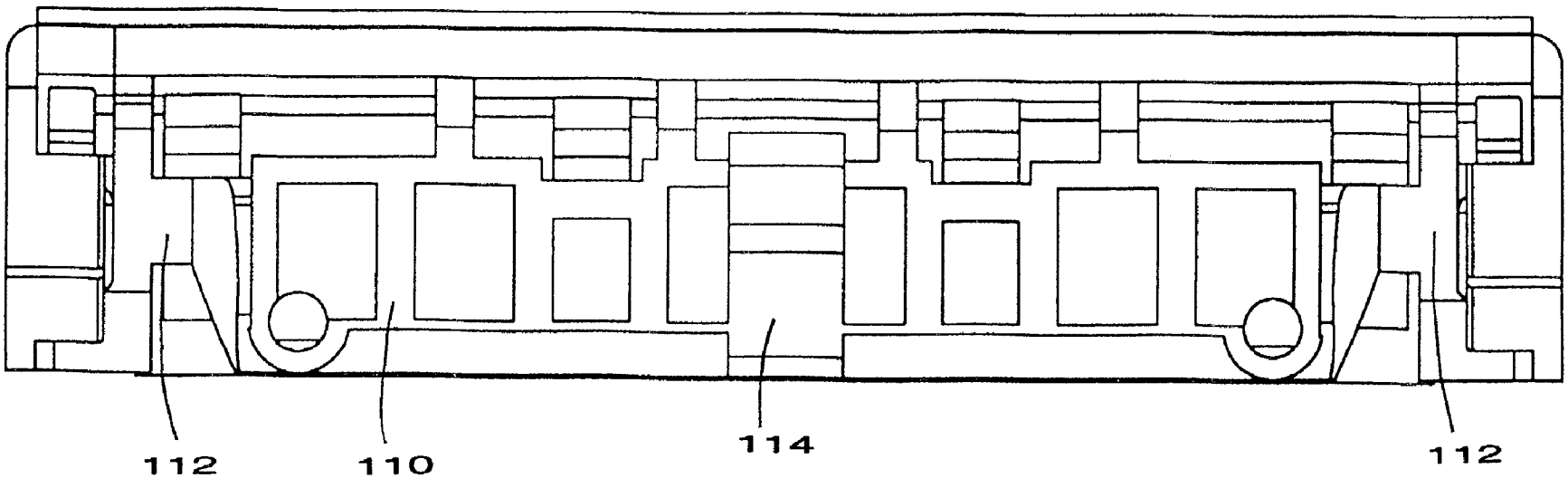
FIG. 6 is a bottom view of the razor head shown in FIG. 1.
Figure 10:
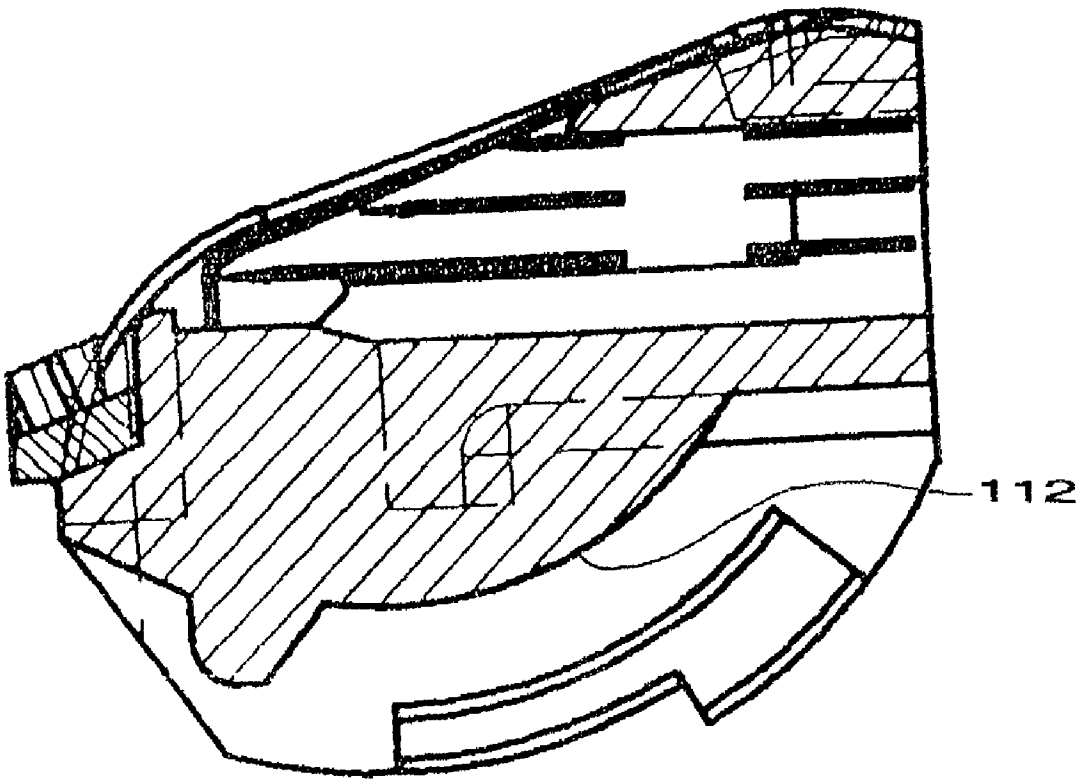
FIG. 10 is a cross-sectional view taken along lines 10—10 of FIG. 2.

The bottom views of FIGS. 5 and 6 and the cross-sectional view of FIG. 10 illustrate the attachment receptacles 112 of this illustrated razor head which are adapted to receive curved attachment members of a razor handle 14 (FIG. 1) in order to allow the illustrated razor head to pivot on the razor handle 14. Unlike conventional pivoting razors now on the market, the illustrated embodiment of the present invention advantageously utilizes the outer end walls of the support base 110, thereby reducing the amount of plastic needed to form the razor head. The attachment receptacles 112 are preferably designed for use with a particular razor attachment member to prevent attachment of the razor head in the wrong direction.

Figure 4:
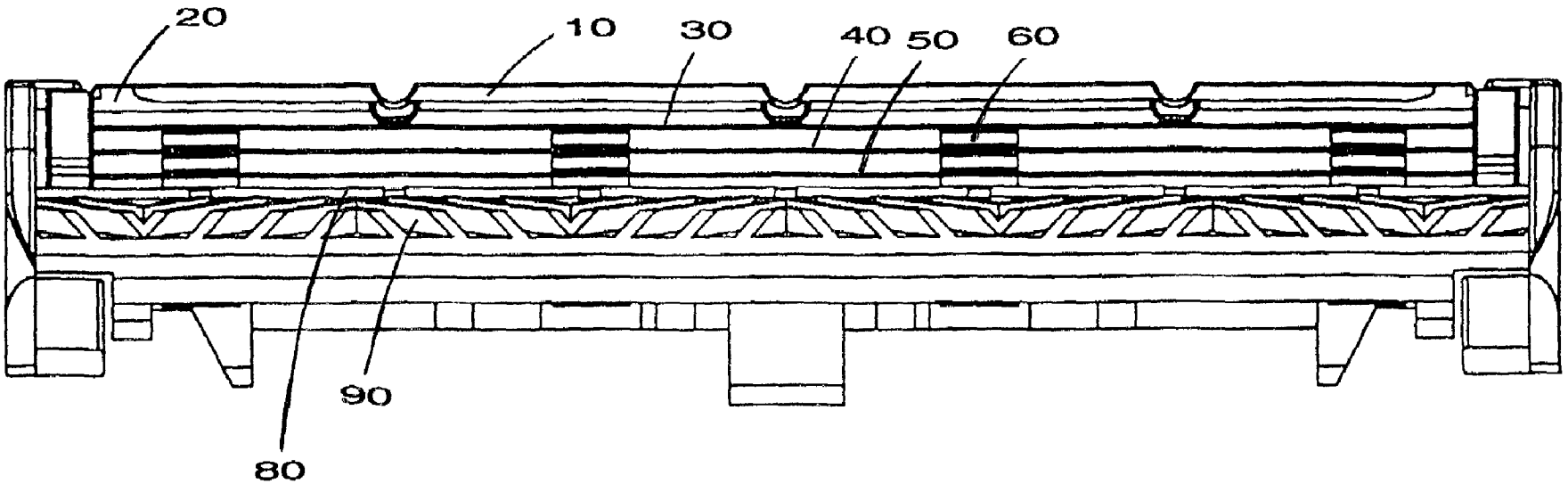
FIG. 4 is a front view of the embodiment shown in FIG. 1.
Figure 7:
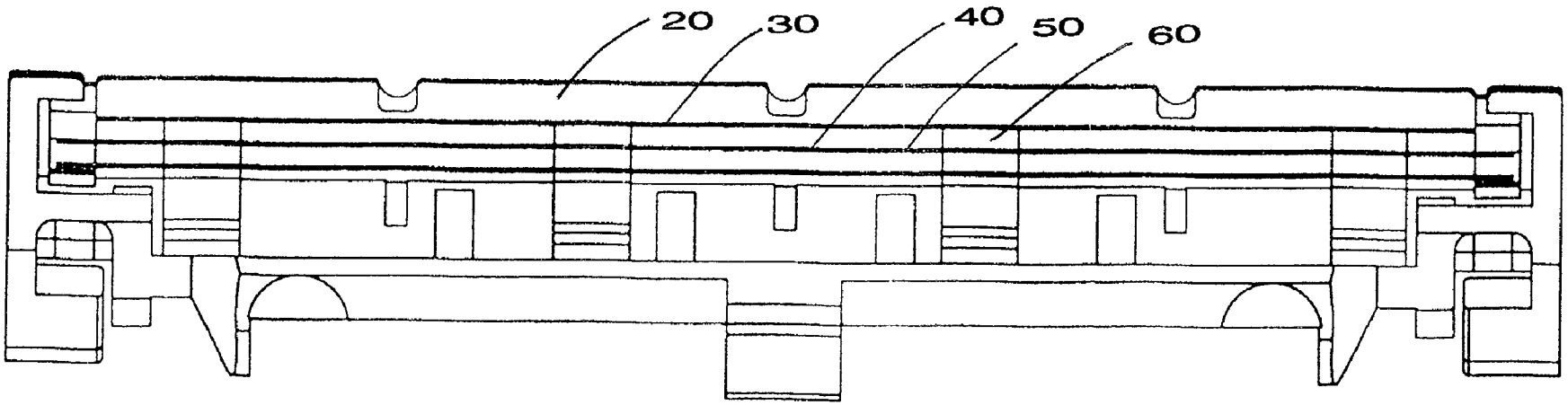

The illustrated embodiment has excellent rinsability characteristics. As illustrated in the frontal view of FIG. 4 and the rear view of FIG. 7, a major portion of the spaces between the blades is unobstructed by support structure in order to enhance the removal of shaving debris during shaving.

Figure 11:
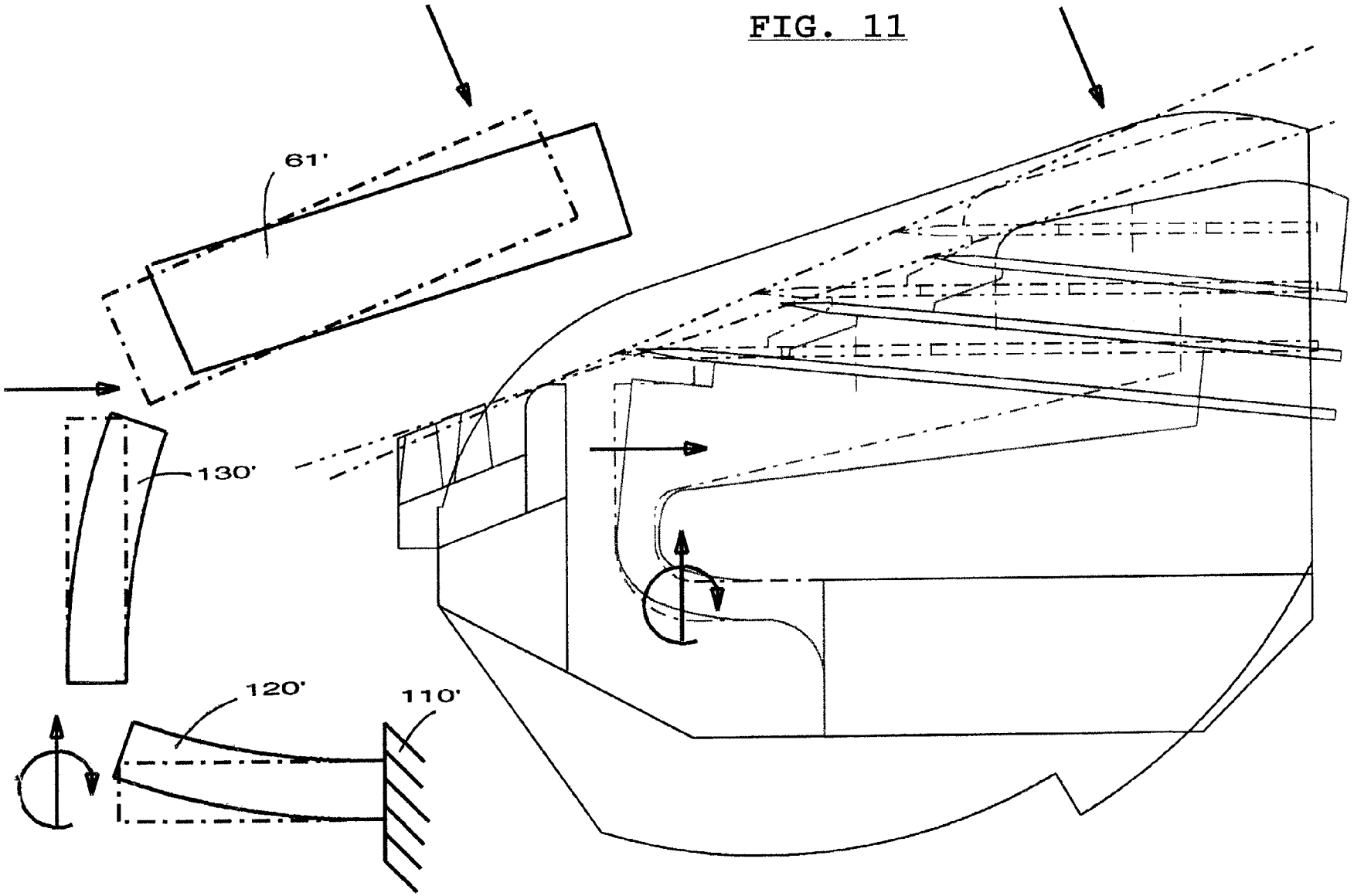
FIG. 11 is a schematic illustration illustrating the composite blade movement of one embodiment of the present invention.

A pivoting return cam 114 is designed to engage a biased return mechanism of a razor in a manner known in the art. From the present description, those skilled in the art will appreciate that by providing pivoting movement to the illustrated razor head, proper balance of the shaving forces on each of the blades will be maintained. The pivoting axis is most preferably located on a shave plane defined by a plane passing through at least two of the blade edges and at a mid-point between the cap and the guard element when the blade package is in a neutral, i.e., unbiased, position. Preferably the pivoting axis is within 0.010 inches of the center of the cap and the guard. If the razor head did not have the ability to pivot relative to the razor, the three-beam arrangement formed by the two resilient portions of the support member and the blade package could result in the blades deviating significantly from a position of optimum skin engagement. With reference to FIG. 11, it can be appreciated that a shaving force exerted primarily on the lower seat blade could move the upper, cap blade out of engagement with a skin surface, if the razor head was not able to pivot relative to the razor. The pivoting action utilized in combination with the novel composite motion provided by the razor head of the present invention maintains the blades in proper skin engagement.

FIG. 5 also illustrates tabs 105 which are preferably integrally formed with side walls 100 and prevent accidental over-stressing of resilient blade support 60. As illustrated, tabs 105 will prevent the blade package from moving too far forwardly.

As shown in FIGS. 1 and 2, the illustrated guard element 80 comprises a plurality of relatively small interruptions along its length. These interruptions leave voids during the first molding step for the resilient material of resilient guard portion 90 during the subsequent molding step and provide anchor sites for the resilient material thereby providing a better connection between resilient guard portion 90 and guard element 80. Since the cross-sectional views shown in FIGS. 8 and 9 are taken along line 8—8 of FIG. 2 which passes through one of the interruptions in guard element 80, guard element 80 is not shown as extending as far upwardly in FIGS. 8 and 9 as it does over most of the razor head width.

Various embodiments of the present invention provide novel movement of skin-engaging elements of the blade package due to the design of the resilient blade package support. The movement of different skin-engaging elements will be different due to their different positions on the blade package and the resiliencies of the first resilient support portion 120 and second resilient support portion 130. As generally illustrated in FIG. 11, the arrangement of the blade package relative to the base 110 is similar to a three-beam arrangement. The lower beam 120 is connected at its rearward end to base 110 and at a forward portion to generally vertical beam 130 which is in turn connected to a third beam 61. From the diagrams in FIG. 11, it will be appreciated that forces exerted on one or more of the blades or the cap of the blade package during shaving will result in rearward movement of second beam 130 and upward movement of the forward portion of lower beam 120 this causing different portions of upper beam 61 to move in different directions providing a novel, composite movement. As illustrated, the forward most portion of third beam 61 will move upwardly (and rearwardly) while more rearward portions will move downwardly (and rearwardly)relative to their original positions. FIG. 11 illustrates the movement of the four skin-engaging elements, i.e. each of the three blades and the cap member, of the blade package relative to the guard element. The original positions of each of these elements is illustrated in phantom while one position of these elements after being moved in response to forces encountered during shaving is illustrated in solid lines.

Figure 12:
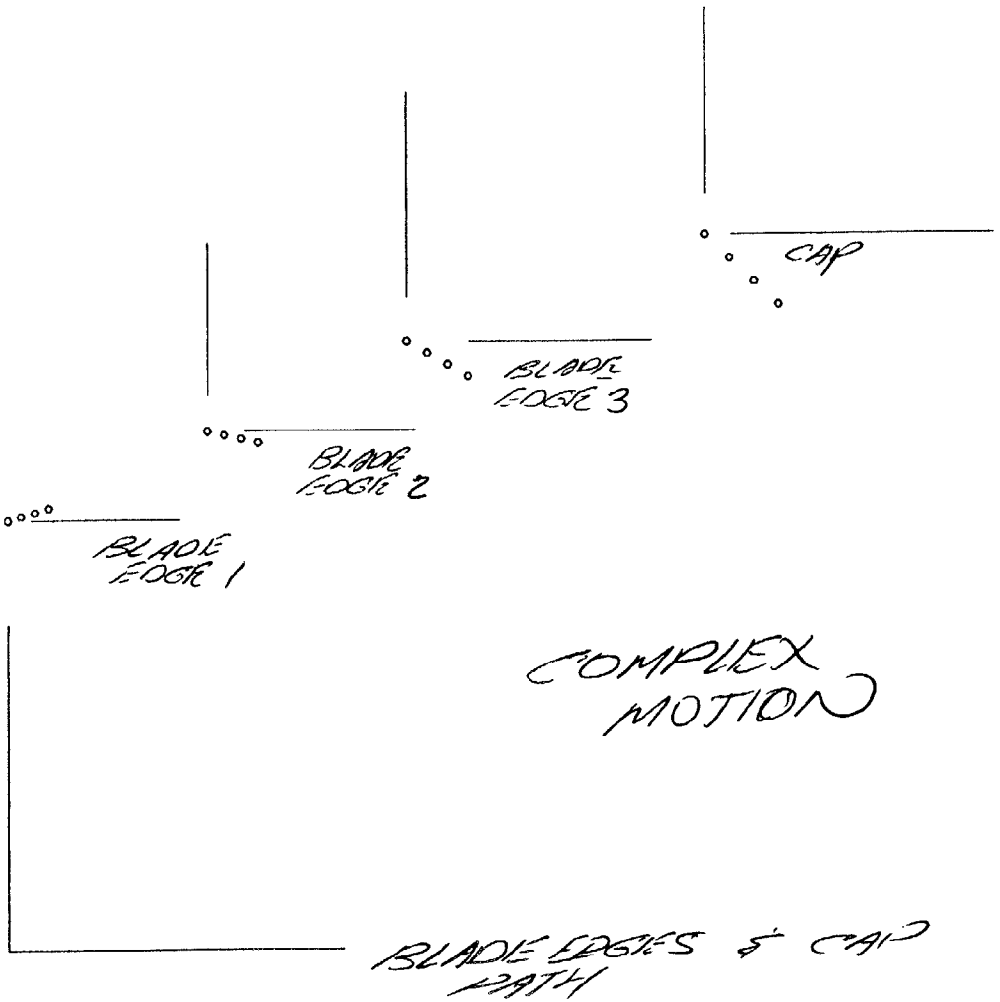
FIG. 12 is a plot of the movement of four skin-engaging elements of one embodiment of the present invention.

FIG. 12 illustrates plots of skin-engaging portions of the blades and cap of the illustrated embodiment of the present invention relative to a base (not shown) in response to forces encountered during shaving. While each skin-engaging element moves rearwardly, the skin-engaging elements move along non-parallel paths. The blade edge of the forward most blade rises upwardly while the middle blade edge moves downwardly and the cap blade edge moves downwardly at a greater slope. The skin-engaging portion of the cap also moves downwardly at a still greater slope than the edge of the cap blade. The movement of different skin-engaging portions of skin-engaging elements along non-parallel paths is referred to herein as "complex" movement.

While the illustrated embodiment of the present invention comprises a resilient support which generally extends forwardly and upwardly from a base to a blade package which is spaced rearwardly from a guard element, other configurations are within the scope of the present invention. For example, an upwardly extending resilient portion of the blade package support need not be generally in the same plane as the leading blade edge but can extend more forwardly to the guard element and can also extend rearwardly, preferably not more than about 0.050 inches.

According to other embodiments of the present invention, more than two resilient beams support one or more skin-engaging elements for composite movement relative to a fixed base. As suggested above, it is also within the scope of the present invention to connect a blade package at a location other than the bottom of the blade package as shown in the figures.

From the present description, those skilled in the art will also appreciate that by varying the length, resiliency and/or positioning of the resilient beams, the composite motion of various skin-engaging elements can be modified as desired. It is also within the scope of another embodiment of the present invention to incorporate a guard element into a resilient beam and/or into the blade package. If the guard element is incorporated into a resilient support, the guard element can move along a path which is different from other skin-engaging elements.

In the preferred illustrated embodiment, the cap, blades and blade package side walls do not move relative to each other except as described. Those skilled in the art, however, will appreciate that certain benefits of the present invention could be retained while allowing one or more of these skin-engaging elements to move relative to each other in a different embodiment of the present invention.

The invention claimed is:

1. A razor head comprising:

a base;

a blade package comprising a blade support and at least one blade coupled to said blade support, said at least one blade having a sharpened edge; and means for movably supporting said blade package comprising a first resilient portion extending generally forwardly from said base and forward the sharpened edge, and a second resilient portion extending generally upwardly from a forward portion of said first resilient portion toward said sharpened edge;

wherein an upper portion of said second resilient portion is integrally formed with a lower portion of said blade support.

2. A razor head according to claim 1 comprising a guard element and wherein said blade package is movably supported for movement relative to said guard element.

3. A razor head according to claim 2 wherein said blade package comprises a plurality of blades.

4. A razor head according to claim 3 wherein forces exerted on one or more of the blades of the blade package during a shaving operation result in rearward movement of said second resilient portion and upward movement of said forward portion of said first resilient portion such that a forward most portion of said blade support moves upwardly and rearwardly while a rearward portion of said blade support moves downwardly and rearwardly relative to an original position of said blade support.

5. A razor head according to claim 4 wherein said blade package comprises at least three blades, and wherein in response to said forces a skin-engaging edge of a forward most blade rises upwardly, a skin-engaging edge of a middle most blade moves downwardly and a skin-engaging edge of a rearward most blade moves downwardly at a greater slope than said movement of said middle most blade.

6. A razor head according to claim 3 wherein each of the plurality of blades has a sharpened edge, and wherein the first resilient portion extends generally forwardly from said base and forward at least one of the sharpened edges.

7. A razor head according to claim 2 wherein said blade package comprises at least three blades.

8. A razor head according to claim 7 wherein one of said blades is unsharpened.

9. A razor head according to claim 8 wherein said unsharpened blade is positioned between two sharpened blades.

10. A razor head according to claim 2 wherein said blade package comprises a cap member.

11. A razor head according to claim 1 in combination with a razor handle wherein said razor head is pivotally connected to said razor handle.

12. A razor head and razor handle combination according to claim 11 wherein said razor head comprises a plurality of blades and pivots about an axis located on a shaving plane defined by the edges of said blades.

13. A razor head and razor handle combination according to claim 12 wherein said razor head comprises a cap and a guard element and said pivotal axis is proximate a midpoint between said cap and said guard element in the absence of external shaving forces.

* * * * *